United States Patent [19]

Dennings et al.

[11] 4,364,224

[45] Dec. 21, 1982

[54] CONTROLLING A YARN PACKAGE AT A WINDING STATION

[76] Inventors: Clifford Dennings, 2d Moss Hall Rd.; Alan Smith, 206 Dill Hall La., both of, Accrington, Lancashire, England

[21] Appl. No.: 221,601

[22] Filed: Dec. 30, 1980

Related U.S. Application Data

[63] Continuation of Ser. No. 20,571, Mar. 15, 1979, abandoned.

[30] Foreign Application Priority Data

Mar. 16, 1978 [GB] United Kingdom ..... 10414/78

[51] Int. Cl.[3] ..... D01H 15/00; B65H 67/08; B65H 49/20

[52] U.S. Cl. ..... 57/263; 242/35.5 R

[58] Field of Search ..... 57/261-263, 57/281, 78, 80, 84, 88, 59, 62; 242/35.5 R, 35.5 A

[56] References Cited

U.S. PATENT DOCUMENTS

| | | | |
|---|---|---|---|
| 3,945,183 | 3/1976 | Landwelrkarp et al. | 57/263 |
| 4,083,171 | 4/1978 | Konig et al. | 57/263 |
| 4,150,532 | 4/1979 | Ligones | 57/263 |

FOREIGN PATENT DOCUMENTS 1095554 12/1967 United Kingdom .

*Primary Examiner*—Donald Watkins
*Attorney, Agent, or Firm*—Donald H. Feldman

[57] ABSTRACT

The invention relates to winding a yarn on a package. A package tray is provided which in an operative position retains the package out of contact with a package driving roller against the effect of a restoring force tending to move the package into driving contact with the driving roller. Retraction of the tray to an inoperative position so as to enable the package to be brought into contact with the driving roller is effected by reducing the restoring force.

Preferably, the invention includes open-end spinning means for producing the yarn and retraction of the tray to the inoperative position takes place during a yarn piecing-up procedure.

7 Claims, 7 Drawing Figures

CONTROLLING A YARN PACKAGE AT A WINDING STATION

This is a continuation of application Ser. No. 020,571 filed Mar. 15, 1979, now abandoned.

FIELD OF THE INVENTION

This invention relates to a method of and apparatus for winding a yarn package. The invention is particularly suitable for application to winding a yarn produced by an open-end spinning means and for facilitating the piecing-up of a yarn following a yarn breakage or machine stoppage.

DESCRIPTION OF THE PRIOR ART

In one known method of piecing-up a yarn in an open-and spinning process, rotation of the yarn package is stopped by its disengagement from the driving roller and the broken end of yarn located. The yarn end is withdrawn from the package, formed into an extended path by passage around a reserve length forming means and then inserted down the yarn doffing tube so as to terminate at a predetermined distance from the fibre collecting surface of the spinning rotor. Upon reducing the extended path of yarn of yarn follows the normal spinning path whereby the end of yarn is permitted to return to the fibre collecting surface of the rotor to contact and twist in newly-fed fibres. The yarn package is brought into contact with the package driving roller and the yarn placed into the nip of the delivery rollers so as to restore continuous withdrawal of the spun yarn from the rotor.

One of the difficulties encountered with this method of piecing-up is that of retaining the yarn package away from the package driving roller such that at an appropriate stage in the procedure the yarn package can be released so as to return into driving contact with the driving roller. For efficient piecing-up, the return of the package into contact with the driving roller should be effected in a simple manner so as to require minimum effort and attention from the operative.

In U.S. Pat. No. 3,945,183 there is disclosed a piecing-up device for an open-end spinning machine including a tray movable to an operative position in which it interposes between the package driving roller and the package so as to retain the latter in a non-driven position. Upon returning the end of yarn to the spinning means the tray is retracted to an inoperative position so as to permit the package to return to a driven position in which it is driven by the package driving roller.

This prior art tray is mounted for movement on a portable housing which is adapted to be attached by the operative to the machine at a winding station in the event of yarn breakage, or following machine stoppage. The housing contains an electromagnet which upon energisation initiates the release of a catch from engagement with the tray to enable it to return to the inoperative position under the influence of a spring.

A disadvantage with such an arrangement is that a source of electrical power has to be made available for energisation of the electromagnet which releases the catch from engagement with the tray. Therefore, in addition to the necessity of ensuring that the apparatus is corectly located on the machine, it is necessary for the operative to plug the device into the electrical source each time a yarn end is pieced-up. The physical burden placed on the operative, because of the need to manually convey the apparatus to the winding stations, will be readily apparent.

To provide a system of this type integral with the machine would require an electromagnet at each spinning station. Since open-end spinning machines have a large number of spinning stations, the cost of such an arrangement becomes uneconomic.

An arrangement is disclosed in British Pat. No. 1,457,741 in which a package tray is provided at each winding station. The tray is movable between a position in which it retains a package out of contact with the package driving roller and an inoperative position in which it permits the package to come into contact with the driving roller. This device requires the provision of a pneumatic cylinder at each winding position and is therefore economically disadvantageous.

SUMMARY OF THE INVENTION

According to the invention apparatus for winding a yarn on a package comprises a package driving roller, package supporting means movable between a position in which the package is supported in a driven position and in contact with the driving roller so as to be driven thereby, and a position in which the package is supported in a non-driven position spaced by a pre-determined distance from the driven position, and a package retaining means movable between an operative position, in which it operates to retain the package in the non-driven position against a restoring force tending to move the package to the driven position, and an inoperative position in which the package can be brought into contact with the package driving roller, wherein the improvement is that the package retaining means moves to the inoperative position upon a reduction of the restoring force on the retaining means.

Preferably the package retaining means is in the form of a tray, which in its operative position interposes between the package and the package driving roller so as to engage and retain the package in the non-driven position.

The apparatus preferably further includes open-end spinning means for producing a spun yarn to be wound into a package by the winding apparatus, fibre feed means for feeding fibres to the spinning means, yarn delivery means for withdrawing the spun yarn from the spinning means, and means for returning a yarn end to the spinning means to contact and twist in fibres fed thereto.

According to a further aspect of the invention a method of winding a yarn into a package comprises the steps of retaining the package by a retaining means at a non-driven position spaced from a package driving roller against a restoring force tending to move the package to a driven position in contact with the package driving roller, reducing the restoring force so as to permit the package retaining means to move to an inoperative position, and returning the package in the driven position so as to collect the yarn thereon.

Preferably, the method includes delivering the yarn to the package from an open-end spinning means, comprising the step of returning an end of yarn to the spinning means, upon reducing the restoring force, so as to contact and twist in fibres fed thereto.

DESCRIPTION OF THE PREFERRED EMBODIMENT

Figure 1:
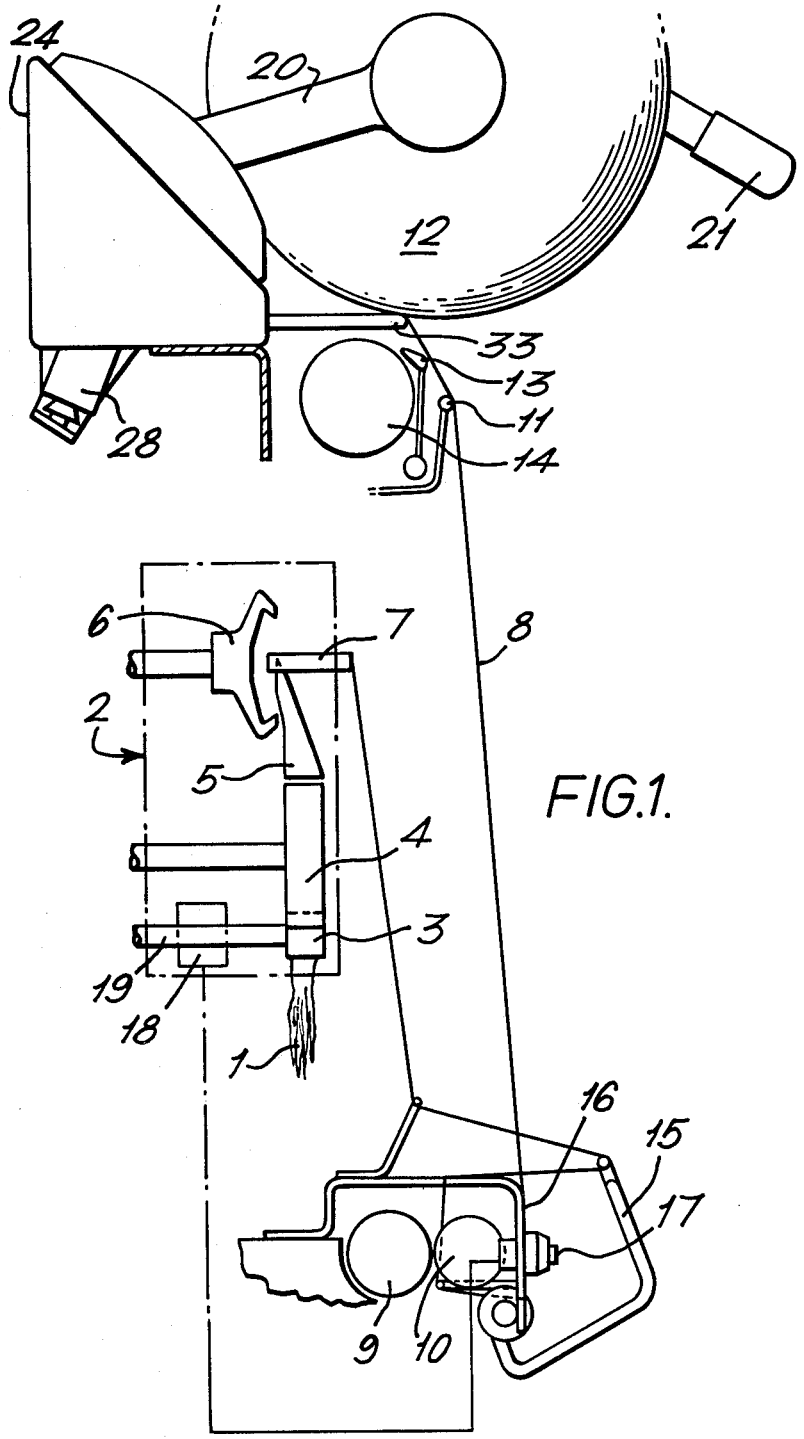
FIG. 1 is a diagrammatic side elevation of a spinning station of a multi-station open-end spinning machine.

Referring to FIG. 1, a sliver 1 is supplied to an open-end spinning unit 2 and fed by a rotating feed roller 3 to a rotating opening roller 4. The opening roller 4 has needles or saw-tooth type wire provided around the peripheral surface thereof so that fibres are separated from the sliver and conveyed to the entrance of a fibre feed duct 5. The fibres are transferred along the fibre feed duct 5 and emerge therefrom so as to be deposited within the cavity of a spinning rotor 6 in which the fibres are accumulated at the maximum internal diameter thereof.

The fibres are withdrawn from the spinning rotor 6 through a doffing tube 7 as a spun yarn 8 by a pair of rotating yarn delivery rollers 9, 10 which are positioned below the spinning unit 2. During normal spinning operation, the yarn 8, after passages around the delivery roller 10, travels upwardly and passes over a yarn guide 11 to be distributed on a package 12 by a reciprocating traverse guide 13. The package 12 is normally in contact with a package driving roller 14 so as to derive relation therefrom.

A yarn piecing-up mechanism is provided for ensuring after yarn breakage or machine stoppage that a yarn end is fed back into the cavity of the spinning rotor 6 to contact and twist in fibres newly fed thereto so as to commence the continuous production of yarn.

A yarn reserve length forming lever 15 is pivotally mounted on a bracket 16 for movement between an extended position, as shown in FIG. 1, in which the yarn 8 is constrained to follow an extended path, and a retracted position in which the extended path is shortened so as to permit the end of yarn to return to the maximum internal diameter of the spinning rotor 6. The mechanism also includes a switch 17 connected to an electromagnetic clutch 18 mounted on a shaft 19 supporting the feed roller 3. At the appropriate moment during the piecing-up operation, the switch 17 is operated to engage the clutch 18 whereby rotation of the feed roller 3 is commenced so as to supply the sliver 1 to the spinning unit 2.

Figure 2:
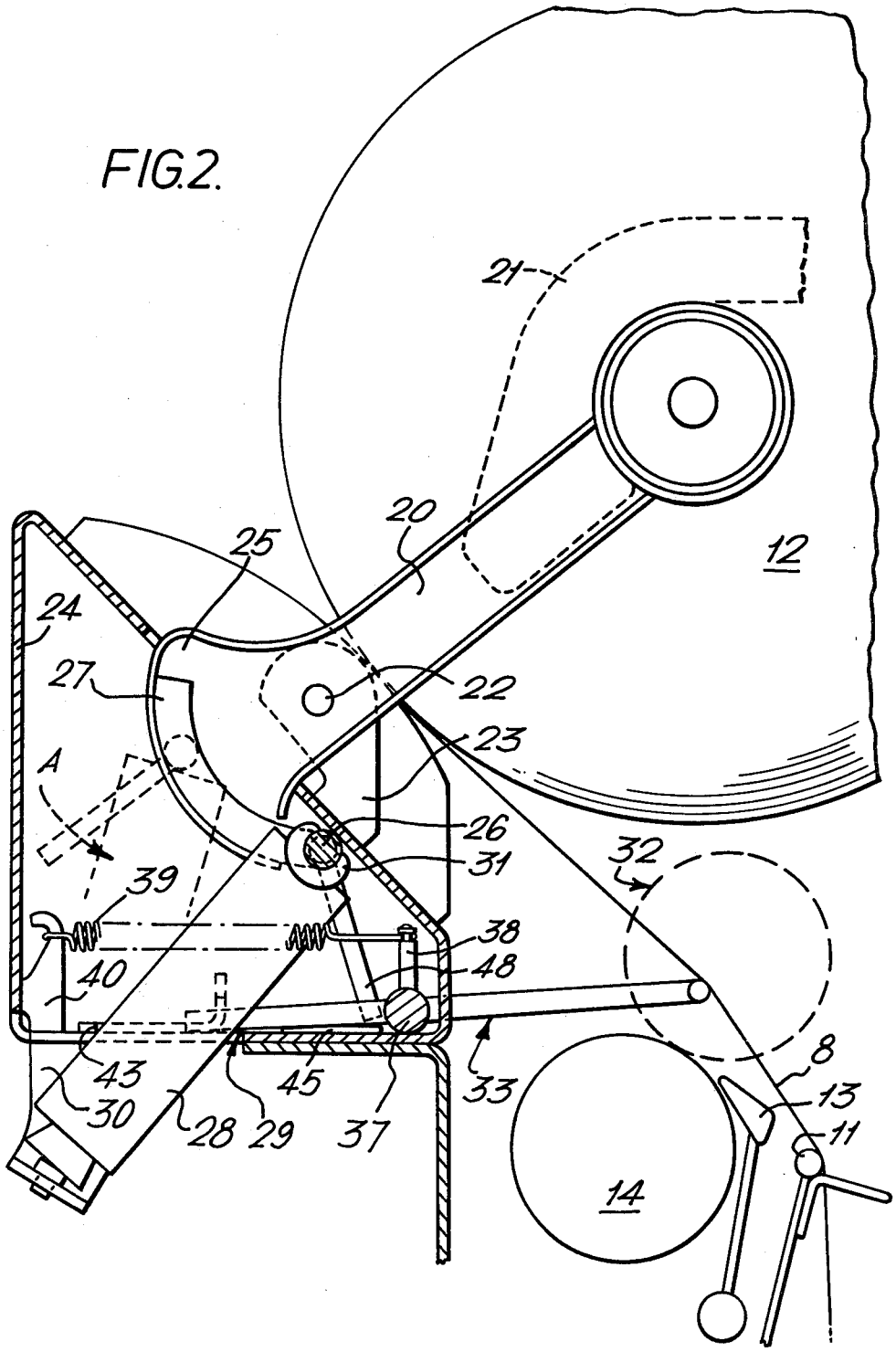
FIG. 2 is a cross-sectional side elevation of a winding apparatus of the spinning station shown in FIG. 1.

As best seen in FIG. 2, the package 12 is supported by a pair of arms 20 one of which has a handle 21 for manually raising and lowering the package 12. Each of the arms 20 is pivotally supported on a pivot pin 22 carried by a bracket 23. The brackets 23 are carried by a hollow beam 24 of substantially triangular cross-section and which extends along the machine so as to serve the remaining stations.

The arms 20 extend into the inside of the beam 24 and terminate in an arcuate end portion 25. Extending between each of the arms 20 is a bar 26 which is so formed as to provide two members 27 arcuately shaped so as to correspond to the arcuately shaped end portion 25 in which they are secured.

During the spinning operation the package 12 is in a driving position in which it is biased into contact with the package driving roller 14 by a restoring force effected by means of a spring loaded cylinder 28 and the weight of the package 12. The lower end of the cylinder 28 extends through an aperture 29 provided in the base of the beam 24 and is pivotally supported by a bracket 30. The upper end of the cylinder 28 is provided with two open-topped bearings 31 which engage the bar 26 at a mid-portion thereof.

It will be appreciated that the restoring force producing the pressure of the package 12 on the driving roller 14 could be derived from other means such as, for example, a gas strut, pneumatic or hydraulic cylinder. If desired, the restoring force may be produced solely by the weight of the package 20.

At the beginning of a package build-up the cylinder 28 is in the position shown in broken line, indicated by A, and this acts on the bar 26 to produce a turning movement on the arms 20 about the pivot pin 22. In this position on empty tube 32, shown in broken line, is pressed against the package driving roller 14 in readings to receive the initial windings of spun yarn. As the diameter of the package increases, the cylinder 28 pivots in a clockwise direction as seen in FIG. 2, and its turning effect on the arms 20 so decreases in relation to the increasing weight of the package 12 that a uniform pressure is produced between the package 12 and the package driving roller 14 during the building of a package.

During the initial period of a piecing-up operation it is necessary to return the package 12 in a non-driven position out of contact with the driving roller 14 until an end of the yarn 8 has been returned to the spinning rotor to effect the piecing. At that time the package 12 has to be returned to a driven position into driving contact with the driving roller 14 so as to accumulate the newly formed yarn.

Figure 3:
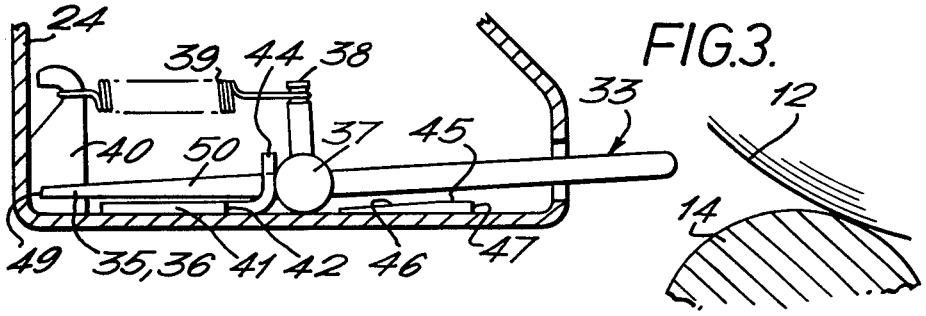
FIGS. 3, 4, 5 and 6 are cross-sectional side elevations indicating the position of the package retaining tray at various stages of the piecing-up procedure.
Figure 5:
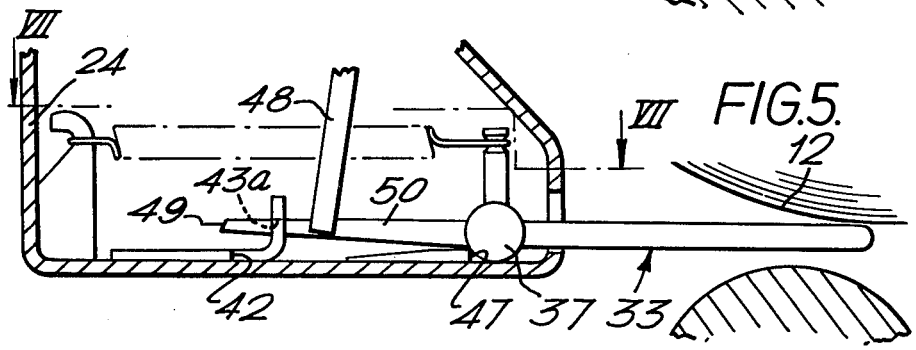

To enable this to be carried out a package retaining tray 33 is provided which can be moved to an operative position, as shown in FIG. 5, in which the peripheral surface of package 12 is retained by the tray 33 in the non-driven position at a predetermined distance from the driving roller 14. The tray 33 can be moved to a retracted or an inoperative position, as shown in FIG. 3, so as to enable the package 12 to descend and return to the driving position into driving contact with the package driving roller 14.

Figure 6:
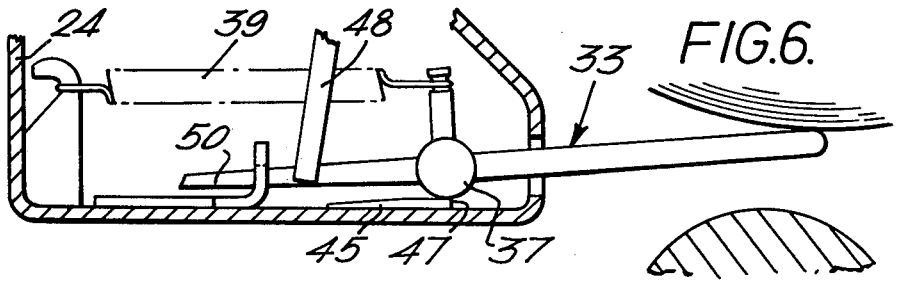
Figure 7:
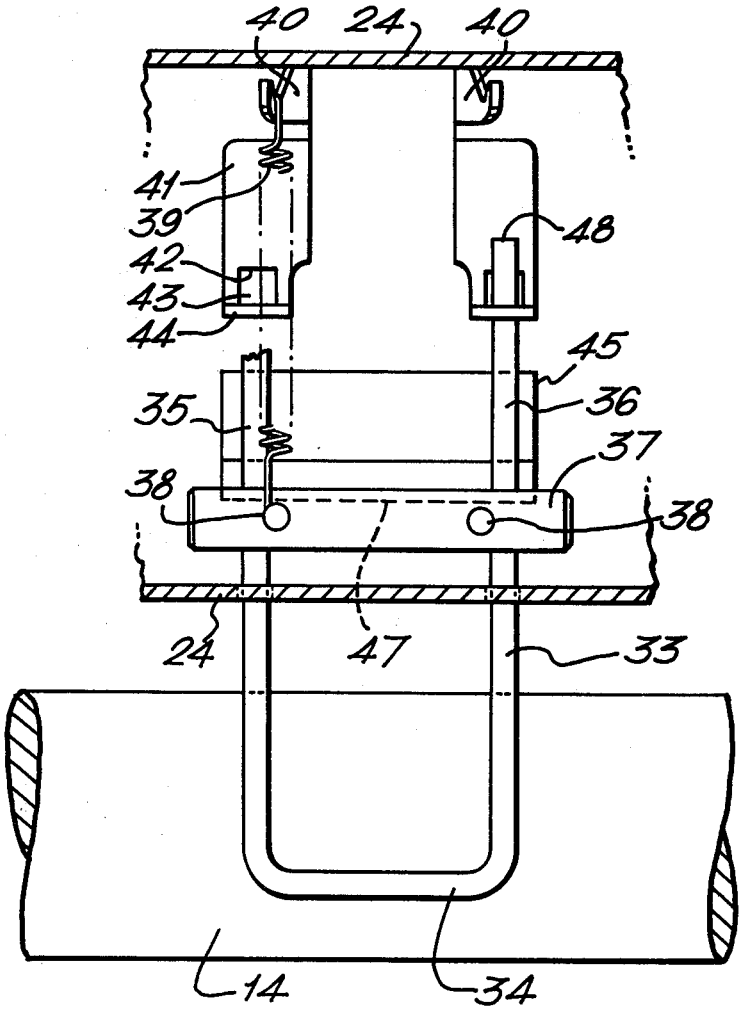
FIG. 7 is a plan view on the line VII—VII of the package retaining tray in the position indicated in FIG. 5.

As best seen in FIG. 7, the package retaining tray 33 comprises a U-shaped bar having a closed end 34 projecting outwardly from the beam 24 and two longitudinal limbs 35, 36, having upper surfaces 50, (FIG. 3) extending from the closed end 34 into the inside of the beam 24 where they terminate in end faces 49. At an intermediate position along the two limbs 35, 36 and extending therebetween is a cylindrical cross member 37. Upstanding from the cross member 37 are two masts 38 to one of which is attached a spring 39. The other end of the spring 39 is anchored to one of a pair of hooks 40 which are integrally formed with the bracket 30 (FIG. 1) and which project upwardly through the aperture 29 in the base of the beam 24. The spring 39 (FIG. 1) is so tensioned when the tray is in the operative position as to tend to return the tray 33 to the inoperative position. Return to the tray 33 to the inoperative position is resisted by several stops (FIGS. 3 to 7) protruding from the base of the beam 24 so as to engage and restrict the movement of the tray 33.

The stops comprise a pair of stop members 41 formed by extensions of the bracket 30 and in which are provided slots 43. Each of the slots 43 is closed at one end by an end face, to provide a pair of first stop surfaces 42, and at the opposite end by an end face, providing a pair of second stop surfaces 43*a*. Each of the stop members 41 has a vertical upturned portion 44 transverse to the limbs 35, 36 in which the slot terminates in the second stop surface 43*a* and through each of which a limb 35, 36 extends.

Forwardly of the stop members 41 is a wedge-shaped stop member 45 extending transversely across the width of the tray 33. An end face of the stop member 45 provides a third stop surface 47 which engages the cross member 37 so as to assist in resisting the movement of the tray 33 from the inoperative position to the operative position. The stop member 45 is provided with an inclined surface 46 which facilitates movement thereover of the cross member 37 when the tray 33 is moved from the inoperative position to the operative position.

Figure 4:
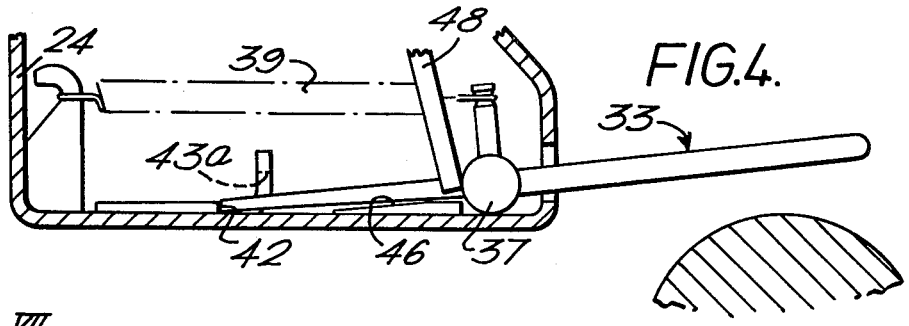

Transfer of the tray 33 from the inoperative position to the operative position is effected by a pair of fingers 48 which extend from the bar 26 to which they are fixed. The fingers 48 engage the cross member 37 so as to transfer the tray 33 to an intermediate position which is between the inoperative position and the operative position, as seen in FIG. 4, when raising the arms 20 to their uppermost position so as to place the package 12 in a park position, as shown in FIG. 2.

The invention operates as follows:

During normal spinning, the package 12 is in a driven position in which it is in contact with the driving roller 14 so as to take up and accumulate spun yarn 8 delivered by the delivery by the delivery rollers 9, 10 from the spinning rotor 6. The tray 33 is held in the inoperative position, as shown in FIG. 3, by the spring 39.

Upon occurence of a breakage of the yarn 8, the arms 20 are pivoted by movement of the handle 21 so as to raise the package 12 to the park position, i.e. its fully raised position, as in FIG. 2. In this position the forces exerted on the arms 20 by the cylinder 28 act on that side of the pivot pin 22 so as to produce a turning effect tending to move the package 12 away from the package driving roller 14. As a result of the movement of the arms 20 to this position the fingers 48 engage the cross-member 37 and move it up the inclined surface 46 of the stop member 45. When the arms 20 are in the fully raised position the tray 33 is in the intermediate position in which the cross-member 37 is a short distance forwardly of the third stop surface 47 so that the end faces 49 of the limbs 35, 36 engage with the first stop member 41, as shown in FIG. 4.

The package arms 20 are then lowered whereby the fingers 48 are withdrawn out of engagement with the cross-member 37. Retraction of the tray 33 is prevented by the engagement of the faces 49 of the limbs 35, 36 with the first stop surfaces 42. As the tray 33 is contacted by the package 12 it rotates about the cross-member 37 through a small angle in a clockwise direction, as viewed in FIG. 5, and the spring 39 causes the tray 33 to retract by a slight amount. Complete retraction of the tray 33 is prevented by the combined effect of the engagement of the cross-member 37 with the third stop surface 47 and the upwardly acting pressure of the upper surfaces 50 of the limbs 35, 36 on the second stop surfaces 43*a* of the slots 43 as a result of the restoring force exerted by the package 12 on the tray 33.

The package supporting tray 33 is now in the operative position illustrated in FIG. 5 so as to retain the peripheral surface of the package 12 at a predetermined distance from the peripheral surface of the package driving roller 14. In this position there is a restoring force produced by the force exerted by the cylinder 28 and the weight of the package 12 which tends to return the package 12 to the driven position. Thus the package 12 is retained by the tray 33 in the non-driven position which is intermediate the driven position and the park position.

It is desirable for successful piecing-up that a precise amount of yarn is returned to the spinning rotor 6 irrespective of the diameter of the package 12. This is achieved in the present invention by arranging for the closed end 34 of the tray 33, when in the operative position, to intersect an arc described by the movement of the axis of rotation of the package 12 about the pivot pin 22 of the arms 20.

The broken end of yarn is located on the package 12 and a length thereof is withdrawn. The tray 33 advantageously effects a braking of the package 12 so that the withdrawal of yarn therefrom is in a controlled manner.

The yarn 8 is then taken along the path as shown in FIG. 1 so as to pass around the reserve loop forming lever 15 and with the end of the yarn terminating within the doffing tube 7 in readings for piecing-up.

The operative then flicks the lever 15 from its extended position to the retracted position so as to shorten the yarn path and enable the end of yarn to return into the cavity of the spinning rotor 6. The switch 17 is operated so that the electro-magnetic clutch 18 is actuated to commence rotation of the shaft 19 and the feed roller 3. Consequently, fibres are delivered to the cavity of the spinning rotor 6, by way of the opening roller 4 and the fibre feed duct 5, where they are contacted and twisted into the tail end of yarn. On return of the lever 15 to its retracted position, the yarn 8 is automatically introduced into the nip of the delivery rollers 9, 10 so that the newly spun yarn is continuously withdrawn from the spinning rotor 6.

In order to return the package 12 to the driven position into contact with the driving roller 14 so as to accumulate the yarn 8, the operative, by means of the handle 21, raises the package 12, by a very slight amount so as to reduce the restoring force on the tray 33. Thus the tray 33 is caused by the spring 39 to rotate by a small amount in an anti-clockwise direction on the cross-bar 37 to the position as shown in FIG. 6.

With the removal of the upwardly acting pressure of the limbs 35, 36 on the second stop surfaces 43*a*, the third stop surface 47 is insufficient to prevent movement of the cross-bar 37 and thus the tray 33 returns in a rapid manner to the inoperative position under the influence of the spring 39. Movement of the tray 33 over the end surface 47 is facilitated by the circular cross section of the cross-bar 37. The operative is then able to return the package 12 to the driven position into contact with the driving roller 14 so as to accumulate the spun yarn 8 delivered from the spinning rotor 6 by the delivery rollers 9, 10.

We claim:

1. In an apparatus for winding a strand of yarn onto a bobbin tube to form and build a yarn package, said apparatus including a driving roller, package support means for holding said tube and supporting it at a position of contact of said tube and yarn thereon with said driving roller and for moving said tube and yarn thereon to a plurality of positions spaced away from said position of contact whereat said tube and yarn thereon are not driven, restoring force means for applying to said tube and yarn thereon a force which tends to move said tube and yarn thereon toward said position of contact and then for maintaining a substantially constant pressure at said position of contact to enhance uniform driving of said tube and yarn thereon for continued winding of yarn thereabout, and retaining and releasing means for retaining said package of tube and yarn thereon at a one of said plurality of said spaced away positions against the impetus of said restoring force of said restoring force means and for releasing said package from said one of said plurality of said spaced away positions namely said retaining position and for thereby permitting said package to be moved to said contact position under the impetus of said restoring force imposed by said means therefor, an improvement comprising engaging means for engaging said retaining and releasing means with said package such that said retaining means retains said package at said retaining position and spaced away from said driving roller, and for disengaging said retaining means from engagement with said package upon movement of said package by a very small amount to yet another one of said plurality of said spaced away positions for thereby permitting said package to be moved to said contact position under the impetus of said restoring force imposed by said means therefor.

2. The improvement according to claim 1, wherein said package retaining and releasing means includes a tray, which in its operative retaining position is interposed between the package and the package driving roller so as to engage and retain the package in the non-driven position.

3. The improvement according to claim 2, wherein said engaging and disengaging means includes a spring having one end attached to said tray and its other end attached to an anchor, whereby the spring is so tensioned when the tray is in said operative interposed spaced away position as to move the tray to an inoperative position to withdraw the same from said operative position upon said movement of said package to said yet another of said plurality of spaced away positions against the impetus of said restoring force.

4. The improvement according to claim 3, wherein said engaging and disengaging means includes stop means engageable by said tray when the latter is in its operable position for preventing said tray from being withdrawn under said tension of said spring and while said tray is impinged upon by said package under the impetus of said restoring force, and for permitting said tray to be disengaged therefrom and be moved from said operable, interposed position under the influence of said tensioned spring and upon movement of said package to said yet another of said plurality of said spaced away positions.

5. The improvement according to claim 4, wherein said tray includes a closed end and two laterally spaced longitudinal limbs extending therefrom, said limbs being interconnected by an arcuate cross member intermediate their lengths, and wherein said stop means includes a first stop surface spaced so as to be engaged by said cross member whereby during movement of the package to said position of interposition of said tray under the impetus of said restoring force the package engages said closed end so as to cause the tray to rotate on the cross member there to be cocked and retained so that upon said subsequent movement of said package to said yet another of said plurality of spaced away positions said tray may be moved from said operable position under said tension from said spring, and also including two second stop surfaces engageable each by a respective one of the limbs before said tray has been so rotated and thus attained said cocked position for subsequent withdrawal from said operative position.

6. The improvement according to claim 5, wherein said stop means includes cocking means for cocking said tray for movement from said interposed operative position, and said cocking means includes abutment and sliding surfaces engageable by the cross-member of the tray when said tray is moved to and in said rotated cocked position.

7. The improvement as in claim 1, wherein said engaging and disengaging means for said retaining and releasing means includes cocking means for cocking said retaining and releasing means at said retaining position spaced away from said driving roller, when said package is moved to said position, in such manner that said retaining and releasing means engages said package thereat, and in such manner that said package is retained at said position under the impetus of said restoring force bearing said package against said retaining means, and for decocking and thus disengaging said retaining and releasing means from bearing contact with said package upon movement of said package to said yet another of said plurality of spaced away positions.

* * * * *